United States Patent [19]

Daniels

[11] 3,996,703

[45] Dec. 14, 1976

[54] WALL PANELING

[75] Inventor: Phillip D. Daniels, West Bloomfield, Mich.

[73] Assignee: Novi Plastics Company, Novi, Mich.

[22] Filed: Oct. 20, 1975

[21] Appl. No.: 623,802

Related U.S. Application Data

[63] Continuation-in-part of Ser. No. 557,271, March 11, 1975.

[52] U.S. Cl. ..... 52/35; 52/261; 52/610; 206/321

[51] Int. Cl.[2] ..... A47K 3/16

[58] Field of Search ..... 52/35, 34, 261, 390, 52/588, 610; 206/321

[56] References Cited

UNITED STATES PATENTS

| | | | |
|---|---|---|---|
| 1,661,168 | 3/1928 | Davis | 52/471 |
| 1,833,672 | 11/1931 | De Vol | 52/390 |
| 2,535,422 | 12/1950 | Jones | 206/321 |
| 2,677,268 | 5/1954 | Hobbs | 52/35 |
| 3,229,438 | 1/1966 | Flagan | 52/588 |
| 3,277,617 | 10/1966 | McBride | 52/261 |
| 3,281,172 | 10/1966 | Kuehl | 52/588 |
| 3,314,203 | 4/1967 | Hill | 52/288 |
| 3,462,900 | 8/1969 | Morrissey | 52/288 |
| 3,559,356 | 2/1971 | Koral | 52/288 |
| 3,564,788 | 2/1971 | Moore | 52/35 |
| 3,626,650 | 12/1971 | Lickliter | 52/288 |
| 3,740,908 | 6/1973 | Moore | 52/35;261 |
| 3,803,789 | 4/1974 | Gibson | 52/471 |

FOREIGN PATENTS OR APPLICATIONS

| | | | |
|---|---|---|---|
| 225,014 | 2/1969 | Sweden | 52/288 |
| 937,756 | 9/1963 | United Kingdom | 52/287;278 |
| 568,852 | 4/1945 | United Kingdom | 52/278 |

*Primary Examiner*—Price C. Faw, Jr.
*Assistant Examiner*—Henry Raduazo
*Attorney, Agent, or Firm*—Cullen, Settle, Sloman & Cantor

[57] ABSTRACT

Wall paneling includes a pair of corner panels, a center panel, and pair of end panels, each of a molded unit construction. The corner panels have a pair of right-angular walls and the other panels are flat. Each of the end and center panels have upright marginal enlargements terminating in edge flanges. The inner enlargement of the end panels and both enlargements of the center panel adjustably overlap and receive therein a corresponding portion of a wall of a corner panel and are coplanar therewith respectively. The end panels extend at right angles to the center panels. Adhesive is interposed between the overlapped portions of the end and center panels and corresponding corner panel. Said paneling may be used for covering the end and back walls of tub enclosures.

11 Claims, 7 Drawing Figures

FIG. 1
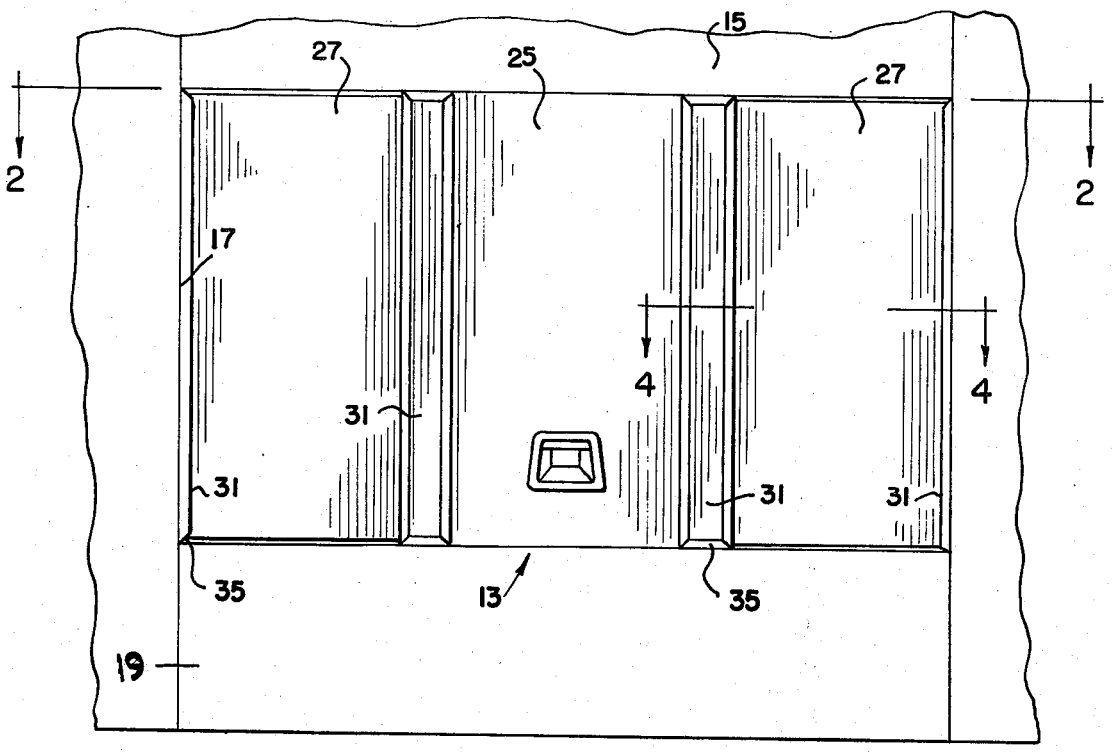
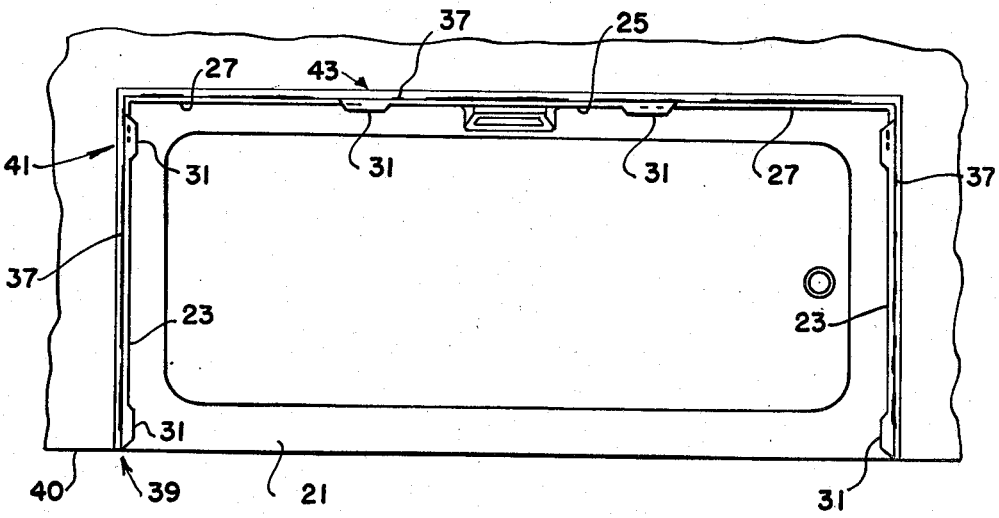
FIG. 2

FIG. 3
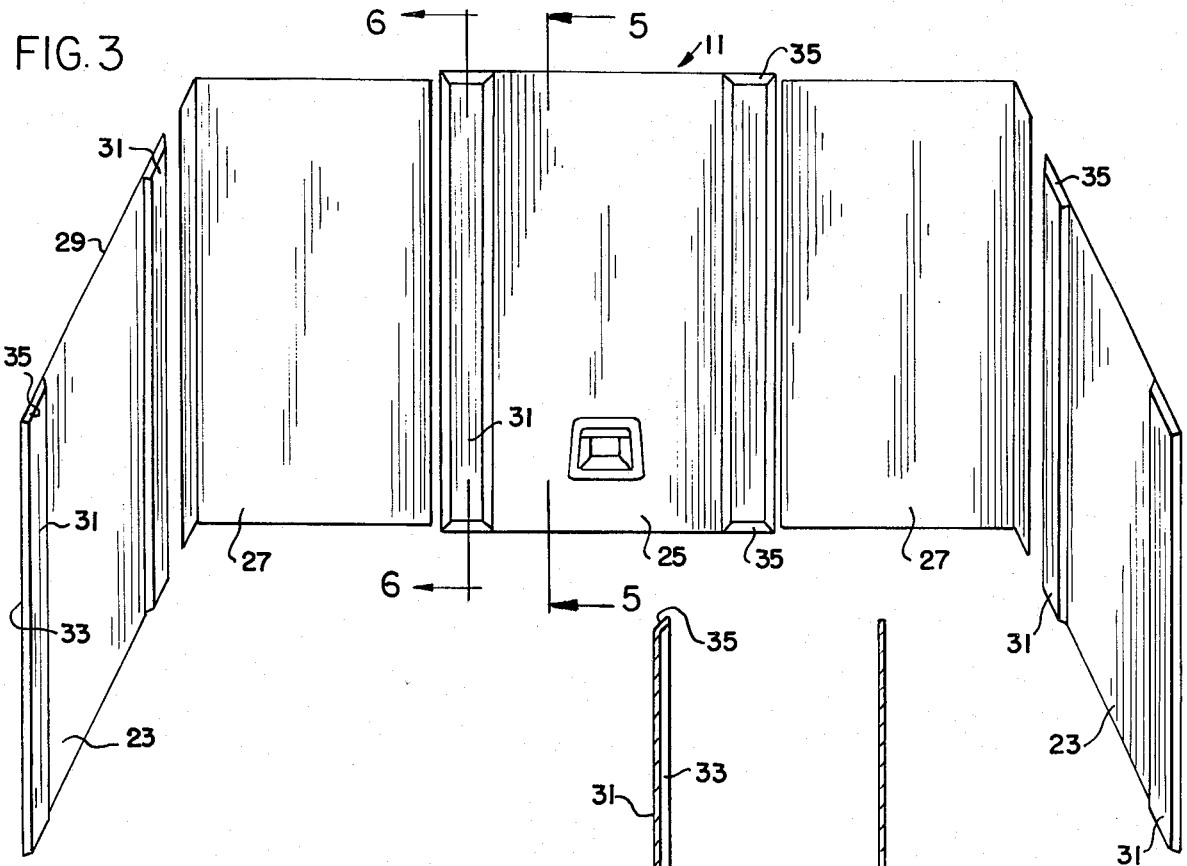
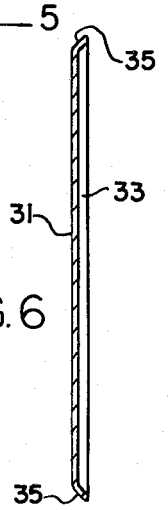
FIG. 6
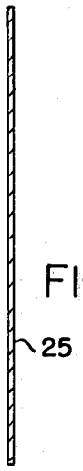
FIG. 5
FIG. 7
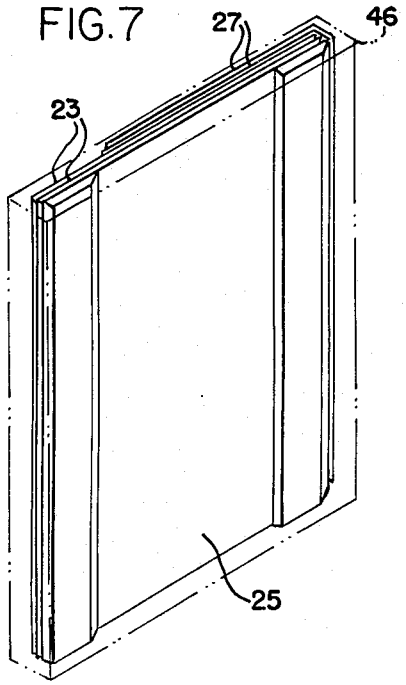
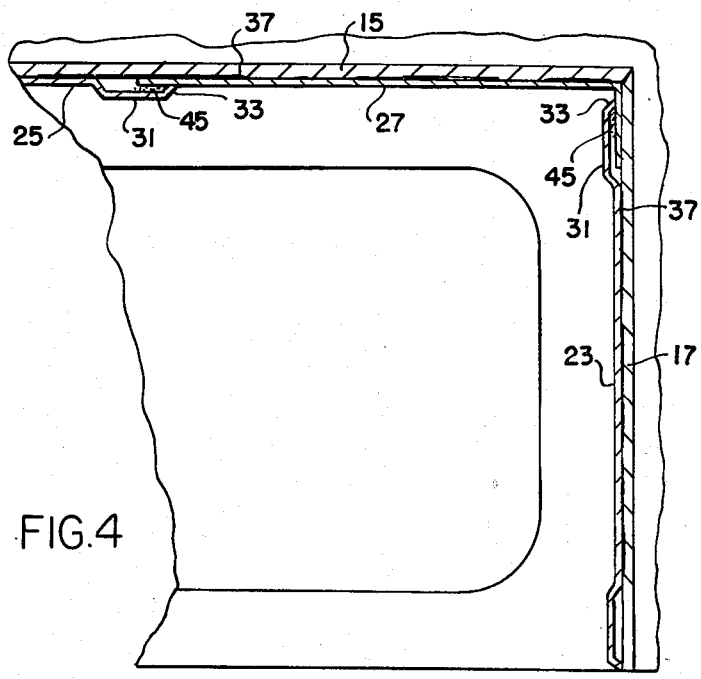
FIG. 4

WALL PANELING

RELATED APPLICATION

This is a continuation in part of my copending patent application Ser. No. 557,271, filed Mar. 11, 1975.

BACKGROUND OF THE INVENTION

In U.S. Pat. No. 3,740,908 there is shown wall paneling which is particularly adapted for use in conjunction with bathtub enclosures. Since the paneling therein includes only end panels with corner extensions, and a center panel, the assembly of these three panels to such an enclosure cannot accomodate all of the normal variation in widths of the said end walls which normally vary between 28 and 30 inches. In said patent, the panel is of a fixed width. Since it is of a fixed width and since the corner extensions bear against the back wall, the device of that patent will not conveniently adapt to a back wall which may be out of perpendicular or out of plumb with the corresponding end walls. Furthermore, a device of that type cannot accomodate the top flange of a tub which is slightly out of horizontal. Another disadvantage of the three panel unit is that it requires a packaging box of a size 60 inches × 60 inches × 4 inches, approximately.

BRIEF DESCRIPTION OF THE INVENTION

It is an object of the present invention to provide an improved wall paneling, which is particularly adaptable for bathtub enclosures, though not limited thereto but, wherein, corner panels are provided, separately and independent of the end and center panels to, thus, provide an adjustability for varying lengths of tub enclosures and for varying widths of tub enclosures and to, further, accomodate for walls that are out of plumb and for tub flanges which are not perfectly horizontal.

It is another object to provide an improved and simplified wall paneling which may be quickly installed and which overcomes the aforementioned disadvantages.

It is another object to provide the three main panels all of the same width, to permit packaging in an easy to handle box of about 30 inches × 60 inches × 4 inches.

These and other objects will be seen from the following specification and claims in conjunction with the appended drawings.

THE DRAWINGS

FIG. 1 is a fragmentary front elevation of a tub enclosure with the present wall paneling in place.

FIG. 2 is a fragmentary section taken in the direction of arrows 2—2 of FIG. 1.

FIG. 3 is an exploded view of the respective end, corner and center panels.

FIG. 4 is a fragmentary section taken in the direction of arrows 4—4 of FIG. 1.

FIG. 5 is a section taken in the direction of arrows 5—5 of FIG. 3.

FIG. 6 is a section taken in the direction of arrows 6—6 of FIG. 3.

FIG. 7 is a perspective view of the paneling parts nested and assembled as a kit within a packaging container shown in phanton lines.

It will be understood that the above drawings illustrate merely a preferred embodiment of the invention, and that other embodiments are contemplated within the scope of the claims hereafter set forth.

DETAILED DESCRIPTION OF THE INVENTION

Referring to the drawings and particularly FIG. 3, the present wall paneling 11, while adapted for general usage is particularly adaptable for a tub enclosure 13, as fragmentarily shown in FIG. 1. Said tub enclosure includes back wall 15 and end walls 17 with conventional bathtub 19 upon the floor within said enclosure and including a continuous top flange 21, FIG. 2.

Said wall paneling, as shown in FIG. 3, includes end panels 23, center panel 25 and corner panels 27.

In the illustrative embodiment, the present panels are molded and are of a unit construction. Each of the panels is a laminate of some tripolymer such as acrilonnytrile-butadiene-styrene as a substrate of plastic material, having a thickness in the range of 0.057 to 0.060 inches. Applied to said substrate is a laminate of an acrylic patterned material which has a printed design on its obverse side of any suitable design or marbilization. The laminate has a thickness of approximately 0.003 inches. The present plastic material for the said panels is supplied by Borg Warner Corporation as well as Dow Chemical and others.

Each of the respective panels have flat walls as at 29, FIG. 3, with the corner panels 27 having a pair of right-angularly related walls, one of which is wider than the other as shown in FIG. 3.

Each of the panels 23–25 are flat on their opposite faces and include outwardly extending elongated marginal enlargements 31 along their outer upright edges. Said enlargements terminate in edge flanges 33, FIG. 6, on one side and top and bottom flanges as at 35.

In one usage of the present wall paneling, it may be adapted to the tube enclosure 13 shown in FIG. 1, defined by end walls 17 and intermediate right-angularly related back wall 15. As a first step, the respective pair of corner panels 27 have applied a suitable adhesive to their rear surfaces as at 37, such as a suitable adhesive mastic material and the corner panels are pressed into position at the corners defined by said and walls and back wall. One such adhesive is referred to as a construction adhesive sold by Franklin Chemical Industries of Columbus, Ohio. It includes synthetic elastomeric polymer and resins. Any suitable pressure-sensitive adhesive could be employed or a suitable water-proof caulking having adhesive characteristics. That is, a construction adhesive which exceeds the specifications of American Plywood Association and FHA-HUD use of materials bulletin No. 60.

As a secondary step, the respective end panels 23 have applied to their back surfaces suitable adhesive material as at 37 as well as within the enlargements as to 45, FIG. 4.

The end panels are then carefully applied to the corresponding end wall so that the inner panel enlargement 31, as shown in FIG. 3, is adjustably assembled over a portion of the corresponding wall of the corner panel, as in FIG. 2, to such extent that the outerpanel enlargement 31 is in cooperative registry with the corner 39, FIG. 2, defined between the end wall 17 where it merges with wall 40.

Just as soon as a proper registry is established between said outer enlargement 31 and corner 39, and a proper adjustive assembly has been completed by the inner enlargement 31 with respect to the corner panel wall portion, said end panel is pressed into position so as to snugly engage the end wall as shown.

At the same time, with additional adhesive material within the enlargement 31 as shown at 45, FIG. 4, said enlargement is pressed snugly against the overlap portion of said corner panel which nests within the recess defined by said enlargement to complete a snug line type assembly.

In this construction, continuous edge flange 33, shown in FIG. 6, engages the corner panel with a line sealing contact.

In the construction of the corner panels, these are slightly shorter in height from the otherwise uniform end and center panels in the range of 1/16 to ⅛ of an inch. This is provided so that the respective overlapped portions of the walls of the corner panels nest within the respective enlargements 31 of said end panels, as well as the corresponding enlargement of the center panel 25.

The adjustable overlap of the inner enlargement 31 with respect to the corner panel is shown at 41, FIG. 2, depending upon the width of the end wall 17.

As a final step, the present adhesive is applied to the rear surface of the center panel 25, as well as into portions of the marginal enlargements 31 thereof. Thereafter, the center panel is adjustably assembled over and with respect to and in overlapping relation with the corresponding portions of the walls of the adjacent corner panels 27.

Here also the enlargements 31 adjustably overlap corresponding portions of the corner panel walls as at 43. FIG. 2, with said overlap portions of the corner panels extending into said enlargements.

This results in the center panel 25 being substantially coplaner with the corresponding wall of the corner panel.

The center panel is, after careful adjustment, pressed into place to assume the assembled relationship shown in FIGS. 1 and 2.

As shown in FIG. 6, each of the enlargements 31 include the edge flange 33 which provides a cooperative line and sealing contact with the corresponding corner panel wall upon assembly. The top flanges 35 of said enlargements extend over and protectively and sealingly enclose top portions of the respective corner panel to complete the assembly.

Due to the fact that tubs in industry lack complete uniformity as to length and width, the present wall paneling is adapted to accomodate such variations. Tubs vary in length between 40 and 62 inches and vary in width between 28 and 31 inches.

By the present adjustability, particularly of the end panels, as well as the center panel, the overlap of the respective marginal enlargements 31 with respect to the corner panels is such as to completely conceal the free edges of the corner panels and to provide what appears to be a continuous surface.

The side edge flanges 33 of the center panel 25 and the inner flanges of the end panels 23 are cut away at their edges a distance approximately the thickness of the overlapped wall portions of the corner panels 27. The inner edges of said flanges are spaced forwardly of the back surfaces of said panels. This provides a clearance space to receive the walls of said corner panels.

CONTINUATION IN PART

The present end and center panels 23 and 25 are of substantially the same width. In the preferred embodiment this is 28 inches. The long side of the corner panel is of a width of 18 inches. Thus, the combined width of the center panel and corner panels long sides is 64 inches. The short side of the corner panel is 3 inches in width. These are illustrated dimensions.

The advantage of making the panels of uniform width is that when disassembled, they nest together as in FIG. 7 to occupy a minimum of storage space, along with the corner panels 27. The disassembled panels may be assembled as a kit within the packaging container 46 shown in phantom lines in FIG. 7.

The most important advantage is that this container is only 30 inches wide, 60 inches high and 4 inches deep. This is easy to store, easy to ship, easy to carry and transport in an automobile. There are presently no units on the market that can approach this reduced size. Most units require a 60 inches × 60 inches × 4 inches carton or a carton of irregular bulky shape. This is difficult to carry and wastes storage space.

Another important advantage of the present uniform width of panel is that a single tool or mold is needed for all three uniform panels. To mold the soap dish into the center panel, the mold merely requires a removable insert of predetermined shape.

Production and manufacturing costs are reduced since all three panels are assembled flat and nest together, FIG. 7. In use any adjustability for length of tube enclosure, is accomplished by the corner panels. The use of the comparatively small package 30 inches by 60 inches by 4 inches is an important merchandising factor due to the ease of storing, handling, and shipping, more units to the truckload and rail car.

While adhesive is shown at 45, FIG. 4, within the enlargements 31, there are usages where such adhesive may be omitted.

For a complete seal, the exterior contact edges of the panels at the overlaps may have applied thereto a line of silicone caulking.

Having described my invention, reference should now be had to the following claims.

I claim:

1. Wall paneling comprising a pair of corner panels, a center panel and a pair of end panels, each panel being molded and of unit construction;

the corner panels each having a pair of right-angular walls, of unequal length, each of the other panels being flat on opposite faces with outwardly extending elongated marginal enlargements along their outer upright edges;

said enlargements terminating in edge flanges on one side and at the top and bottom thereof; the one enlargement of the end panels adjustably overlying and receiving therein the corresponding portion of one wall of a corner panel, with the end panel substantially coplaner therewith respectively; the outer enlargements of the center panel adjustably overlying and receiving therein the corresponding other wall portion of said corner panels respectively, and substantially coplaner therewith, said pair of end panels and said center panel each being of uniform height and each being of substantially uniform width for compact nesting assembly with each other and with said corner panels to permit the use of a container of a height and width of approximately the height and width of said end and center panels; and adhesive means interposed between and securing said overlying portions of said end and center panel enlargements and the respective corner panel wall portion;

the edge flanges of said panel enlargements providing a snug sealing line contact with and along the corresponding underlying wall of an adjacent corner panel; so that said center panel is adapted to adjustably overly the edges of one wall of each corner panel and always present a finished edge and thereby cover the rough edges of said corner panels if trimmed during installation.

2. In the wall paneling of claim 1, said end and center panels being of uniform height; said corner panels being of slightly less height so that the underlying wall portions thereof are enclosed within the adjacent panel enlargements, respectively.

3. In the wall paneling of claim 2, the reduced height of said corner panels being 1/16 to ⅛ inch, substantially.

4. In the wall paneling of claim 1, the edges of said edge flanges being coplaner with the back of the corresponding panel for a snug sealing contact over the underlying portions of said corner panel walls, respectively.

5. In combination with a wall recess having parallel spaced end walls and a back wall at substantially right angles thereto;

wall paneling comprising a pair of corner panels, a center panel and a pair of end panels, each panel being molded and of unit construction, each of the corner panels having a pair of right-angular walls, of unequal length projected into and along the respective upright corners between said end walls and back wall;

said pair of end panels and said center panel each being of substantially uniform width for compact nesting assembly with each other and with said corner panels to permit the use of a container of a height and width of approximately the height and width of said end and center panels; each of the other panels being flat upon opposite faces with outwardly extending elongated marginal enlargements along their outer upright edges; said enlargements terminating in edge flanges on one side and at the top and bottom thereof, said end panels bearing against the corresponding end wall; the one enlargements of the end panels adjustably overlying and receiving therein a corresponding portion of one wall of a corner panel with the end panels substantially coplaner therewith, respectively;

the center panel bearing against said back wall, the outer enlargements of the center panel adjustably overlying and receiving therein the corresponding other wall portion of said corner panels respectively and substantially coplaner therewith;

so that said center panel is adapted to adjustably overly the edges of one wall of each corner panel and always present a finished edge and thereby cover the rough edges of said corner panels if trimmed during installation;

said end panels extending at right angles to said center panel; and adhesive means respectively interposed between and securing the end, corner and center panels and the adjacent back and end walls.

6. In the wall paneling of claim 5, said end and center panels being 28 inches wide approximately, said corner panels having sides of a width of 3 inches and 18 inches approximately, facilitating the use of a storage, carrying and shipping container having the dimensions 30 inches × 60 inches × 4 inches approximately.

7. In the combination of claim 5, the edge flanges of said panel enlargements providing a snug sealing line contact with and along the corresponding underlying wall of an adjacent corner panel and the adjacent end wall.

8. In the combination of claim 7, the adjustable overlap of said end panels relative to the corner panel walls permitting the outer upright edge of the end panels to register with the corresponding outer upright wall edge, at the same time, retaining a substantial overlap of the inner upright edge of said end panel with a wall portion of the adjacent corner panel, to compensate for varying wall widths, the adjustable overlap of said center panel edges relative to the corresponding corner panel wall compensating for variations in distance between end walls, while maintaining a substantial overlap with said corner panels.

9. In the combination defined in claim 5, an additional adhesive means respectively interposed between and securing the overlapped portions of said end and center panel enlargements and the respective corner panel wall portions.

10. In the combination of claim 5, said combination including a tub assembled within the bottom of said wall recess coextensive in width and length, with and bearing against said end and back walls; said tub having a top peripheral flange; said panels supported upon said flange; the adjustability of said end and center panels with respect to the corner panels compensating for any out of plumb at the corners between said end and back walls; and any variations of the said tub flange with the horizontal.

11. In the combination of claim 5, said adhesive means also interposed between the walls of the corner panels and the adjacent end and back wall.

* * * * *